US007204043B2

(12) United States Patent
Kilgore

(10) Patent No.: US 7,204,043 B2
(45) Date of Patent: Apr. 17, 2007

(54) ARTICLE OF FOOTWEAR WITH UPPER SUPPORT ASSEMBLY

(75) Inventor: Bruce J. Kilgore, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 63 days.

(21) Appl. No.: 10/916,020

(22) Filed: Aug. 11, 2004

(65) Prior Publication Data

US 2006/0032091 A1 Feb. 16, 2006

(51) Int. Cl.
*A43B 13/42* (2006.01)

(52) U.S. Cl. ..... 36/68; 36/105

(58) Field of Classification Search ..... 36/68, 36/69, 105, 101, 72 B, 48
See application file for complete search history.

(56) References Cited

U.S. PATENT DOCUMENTS

| | | | | |
|---|---|---|---|---|
| 277,614 | A | 5/1883 | Roosevelt | |
| 1,246,630 | A * | 11/1917 | MacGown | 36/68 |
| 1,515,086 | A | 11/1924 | Baluta | |
| 1,873,222 | A | 8/1932 | Shaw | |
| 1,895,141 | A | 1/1933 | Watanabe | |
| 1,946,591 | A | 2/1934 | Saito | |
| 2,425,955 | A | 8/1947 | Rouch | |
| 2,513,005 | A | 6/1950 | Crawford | |
| 2,523,221 | A * | 9/1950 | Maloy | 36/1 |
| 4,019,265 | A | 4/1977 | Epstein | 36/7.1 R |
| 4,194,308 | A | 3/1980 | Karlsson | 36/9 R |
| 4,255,877 | A | 3/1981 | Bowerman | 36/129 |
| 4,287,675 | A | 9/1981 | Norton et al. | 36/129 |
| 4,288,929 | A | 9/1981 | Norton et al. | 36/69 |
| 4,503,628 | A | 3/1985 | Mancinelli et al. | 36/58.6 |
| 4,642,916 | A | 2/1987 | Collins | 36/58.6 |
| 5,090,140 | A | 2/1992 | Sessa | 36/138 |
| 5,448,840 | A | 9/1995 | Cheskin | 36/32 R |
| 6,442,874 | B1 | 9/2002 | Long | 36/97 |
| 6,558,784 | B1 | 5/2003 | Norton et al. | 428/304.4 |
| 6,655,049 | B2 | 12/2003 | Sato et al. | 36/36 R |
| 6,772,539 | B1 | 8/2004 | Tai | 36/11.5 |

FOREIGN PATENT DOCUMENTS

| | | |
|---|---|---|
| FR | 2 720 235 A1 | 12/1995 |
| GB | 773 039 A | 4/1957 |

OTHER PUBLICATIONS

Website: "ITW Fastex: Clear Fasteners, Clear Snap Rivet"; Copyrighted 2002-2003.

* cited by examiner

*Primary Examiner*—Ted Kavanaugh
(74) *Attorney, Agent, or Firm*—Banner & Witcoff, Ltd.

(57) ABSTRACT

An article of footwear includes a sole assembly and an upper secured to the sole assembly. A heel counter is secured to the sole assembly. The heel counter includes an inner portion and an outer portion secured to the inner portion. A portion of the upper is captured between the inner and outer portions of the heel counter.

31 Claims, 4 Drawing Sheets

ARTICLE OF FOOTWEAR WITH UPPER SUPPORT ASSEMBLY

FIELD OF THE INVENTION

This invention relates generally to an article of footwear, and, in particular, to an article of footwear having a support assembly for an upper of the article of footwear.

BACKGROUND OF THE INVENTION

A conventional article of athletic footwear includes two primary elements, an upper and a sole assembly. The upper is often formed of leather, synthetic materials, or a combination thereof and comfortably secures the footwear to the foot, while providing ventilation and protection from the elements. The sole assembly generally incorporates multiple layers that are conventionally referred to as an insole, a midsole, and an outsole. The insole is a thin cushioning member located within the upper and adjacent the sole of the foot to enhance footwear comfort. The midsole, which is traditionally attached along its peripheral edge to the upper, forms the middle layer of the sole assembly and serves a variety of purposes that include controlling potentially harmful foot motions such as pronation, attenuating ground reaction forces, and absorbing energy. The outsole forms the ground-contacting element of footwear and is usually fashioned from a durable, wear resistant material that includes texturing to improve traction.

An article of footwear often incorporates a heel counter at the rear of the footwear, which is contoured to wrap around the user's heel and along the sides of the footwear. The heel counter provides stability and support for the user's heel. The upper wraps around the rear exterior surface of the heel counter and is secured thereto, with a seam being provided in the upper at the rear of the heel counter.

The manufacture of a typical article of athletic footwear is quite complex, and involves a number of steps including stitch and turn collar lining, and three-dimensional stitching and molding of the back portion of the article of footwear. Performing these complex tasks and providing a consistent heel fit is difficult, time consuming, labor intensive, and requires a large investment in capital equipment.

It is an object of the present invention to provide an article of footwear that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear having a heel counter with a simplified construction and that provides a consistent heel fit.

In accordance with a first aspect, an article of footwear includes a sole assembly and an upper secured to the sole assembly. A heel counter is secured to the sole assembly. The heel counter includes an inner portion and an outer portion secured to the inner portion. A portion of the upper is captured between the inner and outer portions of the heel counter.

In accordance with another aspect, an article of footwear includes an upper assembly formed of a heel counter having an inner portion and an outer portion secured to the inner portion and an upper having a flat substantially U-shaped configuration in an unassembled condition. Ends of arms of the U-shaped upper are captured between the inner and outer heel counters in an assembled condition. A midsole is secured to the upper assembly, and an outsole is secured to the midsole.

In accordance with a further aspect, an article of footwear includes a sole assembly. A support assembly secured to the sole assembly has an inner portion and an outer portion secured to the inner portion with a fastener. The fastener comprises a plurality of projections formed on one of the inner portion and outer portion and a plurality of apertures formed in the other of the inner portion and outer portion. Each aperture is configured to receive a corresponding projection. An upper has a flat substantially U-shaped configuration in an unassembled condition, with portions of the U-shaped upper being captured between the inner and outer heel portions of the support assembly in an assembled condition.

Substantial advantage is achieved by providing an article of footwear having a heel counter in accordance with preferred embodiments of the present invention. In particular, preferred embodiments of the present invention can provide an article of footwear with a simplified construction and one that provides a consistent and comfortable heel fit. The construction of the present invention can allow for automated assembly methods, reducing the labor and capital equipment required to make an upper, and simplify the assembly process, reducing the time and technical skills required to assemble an article of footwear.

These and additional features and advantages of the invention disclosed here will be further understood from the following detailed disclosure of certain preferred embodiments.

Figure 2:
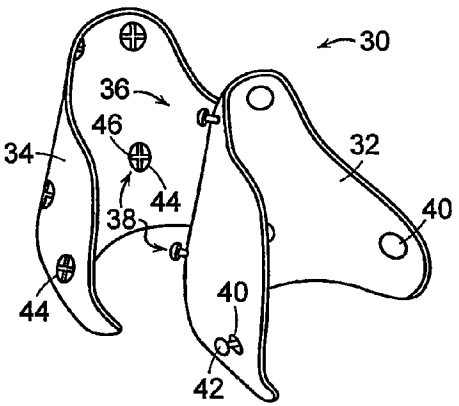
FIG. 2 is a perspective view of the support assembly of the article of footwear of FIG. 1, shown in an unassembled condition.

The figures referred to above are not drawn necessarily to scale and should be understood to provide a representation of the invention, illustrative of the principles involved. Some features of the article of footwear having a heel counter depicted in the drawings have been enlarged or distorted relative to others to facilitate explanation and understanding. The same reference numbers are used in the drawings for similar or identical components and features shown in various alternative embodiments. Articles of footwear having a heel counter as disclosed herein, would have configurations and components determined, in part, by the intended application and environment in which they are used.

DETAILED DESCRIPTION OF CERTAIN PREFERRED EMBODIMENTS

Figure 1:
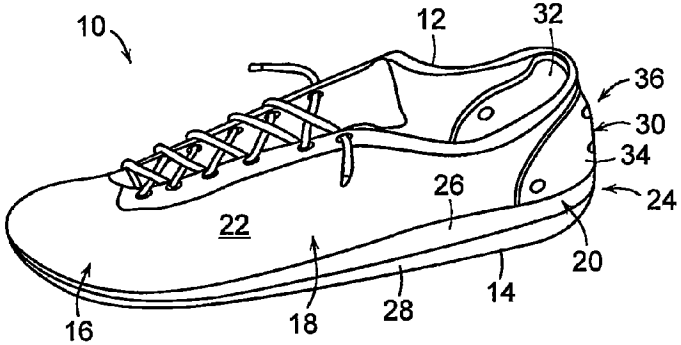
FIG. 1 is a perspective view of an article of footwear in accordance with a preferred embodiment of the present invention.

The present invention may be embodied in various forms. A preferred embodiment of an article of footwear 10 in accordance with the present invention is shown in FIG. 1. Footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Footwear 10 includes an upper 22, and a sole assembly 24 secured to upper 22. Sole assembly 24 may be secured to upper 22 by an adhesive, or any other suitable fastening means. Upper 22 receives and comfortably secures footwear 10 to a foot of a wearer. Upper 22 may be formed of leather, synthetic materials, or a combination thereof. Suitable materials for upper 22 will become readily apparent to those skilled in the art, given the benefit of this disclosure.

Sole assembly 24 is generally disposed between the foot of the wearer and the ground. As with conventional articles of athletic footwear, sole assembly 24 includes an insole (not shown) located within upper 12, a midsole 26, and an outsole 28. Midsole 26 is attached to upper 22, typically by adhesive, and functions as the primary shock-attenuating and energy-absorbing component of footwear 10. Outsole 28 is attached to the lower surface of midsole 26, typically by adhesive, and forms the ground-contacting element of footwear 10. Outsole 28 is usually fashioned from a durable, wear resistant material that includes texturing to improve traction. Suitable materials for the insole, midsole 26 and outsole 28 will become readily apparent to those skilled in the art, given the benefit of this disclosure.

A preferred embodiment of a support assembly 30 is located in heel portion 20 of footwear 10. A lower surface of support assembly 30 is secured to sole assembly 24 by adhesive, stitching, or other suitable fastening means. Upper 22 is secured directly to support assembly 30 as discussed in greater detail below. In the illustrated embodiment, in addition to supporting upper 22, support assembly 30 acts as a heel counter, and is contoured to wrap around the user's heel and along the sides of footwear 10 in heel portion 20. Thus, support assembly 30 provides stability and support for the user's heel, and shape and registration for the body of footwear 10, as well as an anchoring device for upper 22.

As can be seen more clearly in FIG. 2, support assembly 30 is formed of a first or inner portion 32 and a second or outer portion 34. Inner portion 32 is secured to outer portion 34 by a fastener 36. In the illustrated embodiment, fastener 36 comprises a plurality of rivets 38. In certain preferred embodiments, rivets 38 are plastic snap rivets, such as those supplied by ITW Fastex of Des Plaines, Ill.

Each rivet 38 is formed of a first portion 40 having a projection 42, and a second portion 44 having a recess 46. When support assembly 30 is assembled, projections 42 are received in recesses 46, thereby securing inner portion 32 to outer portion 34.

In the illustrated embodiment, there are six first portions 40 with projections 42 on inner portion 32, and six mating second portions 44 with recesses 46 on outer portion 34. A first pair of first portions 40 and projections 42 is positioned at the rear lower edge of inner portion 32, and a second pair of first portions 40 and projections 42 is positioned above the first pair near the rear top edge of inner portion 32. A lower medial first portion 40 and projection 42 are positioned at a forward lower edge on the medial side 12 of inner portion 32. A lower lateral first portion 40 and projection 42 are positioned at a forward lower edge on the lateral side 14 of inner portion 32. The six mating second portions 44 and recesses 46 are found at corresponding positions on outer portion 34. It is to be appreciated that there need not necessarily be six first portions 40 and projections 42 mating with six second portions 44 and recesses 46, and that more or less than six mating pairs may be used, and that other numbers of mating pairs are considered to be within the scope of the present invention.

It is to be appreciated that rivets 38 could be secured to inner portion 32 and outer portion 34 in the reverse manner, that is, first portions 40 having projections 42 could be secured to outer portion 34, and second portions 44 having recesses 46 could be secured to inner portion 32.

Figure 3:
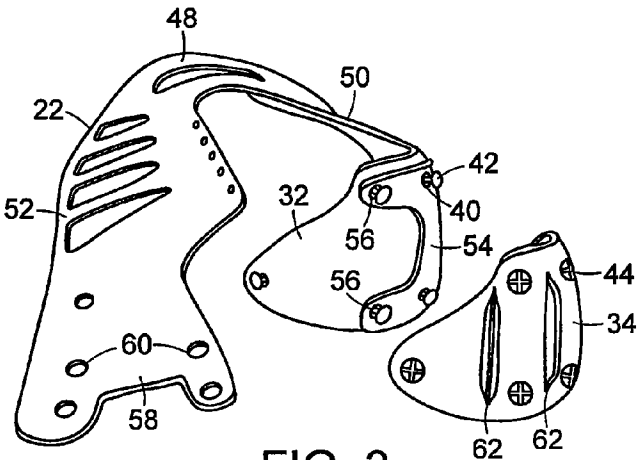
FIG. 3 is a perspective view of the support assembly and upper of the article of footwear of FIG. 1, shown partially assembled.

As can be seen in FIG. 3, upper 22 preferably has a substantially flat U-shaped configuration in an unassembled condition. A base portion 48 of the U-shaped upper 22 forms the toe portion 16 of upper 22 when it is in its assembled condition. A medial arm 50 of the U-shaped upper 22 forms the medial midfoot portion 16 and heel portion 20 of upper 22 when it is in its assembled condition. Similarly, a lateral arm 52 of the U-shaped upper 22 forms the lateral midfoot portion 16 and heel portion 20 of upper 22 when it is in its assembled condition.

A first or medial end 54 of upper 22 at the end of medial arm 50 includes a plurality of apertures 56. A second or lateral end 58 of upper 22 at the end of lateral arm 52 similarly includes a plurality of apertures 60. Apertures 56, 60 are used in conjunction with fastener 36 to secure upper 22 to support assembly 30. Specifically, apertures 56, 60 receive projections 42 of first portions 40. To assemble upper 22 to support assembly 30, medial end 54 is wrapped about inner portion 32 and apertures 56 of medial end 54 are placed on projections 42. Lateral end 58 is then wrapped about inner portion 32 over medial end 54 and apertures 60 are placed on projections 42. Outer portion 34 is then pressed into engagement with inner portion 32, with projections 42 being received in snap-fit fashion in recesses 46. In this way, medial end 54 and lateral end 58 of upper is captured, or sandwiched, between inner portion 32 and outer portion 34 of support assembly 30, securely fastening upper 22 to support assembly 30, and registering or aligning upper 22 with respect to support assembly 30. Upper 22 and support assembly 30 are then secured to sole assembly 24 in typical fashion such as by an adhesive.

The embodiment illustrated herein shows one way of securing upper 22 to support assembly 30. It is to be appreciated that upper 22 could be secured to support assembly 30 by other means including, for example, adhesives, welding, or a variety of mechanical fasteners including, for example, hook and loop fasteners. Other suitable means of securing upper 22 to support assembly 30 will become readily apparent to those skilled in the art, given the benefit of this disclosure.

Inner portion 32 of support assembly 30 may be formed of any suitable material, especially a material that provides comfort to the user, including for example, thermoplastic polyurethane, thermoplastic rubber, or polyester elastomers. Outer portion 34 of support assembly 30 may be formed of any suitable material, especially a material that provides support, impact resistance, and aesthetics for the intended use of footwear 10. Exemplary materials for outer portion 34 include thermoplastic polyurethane having a higher modulous than that of the inner counter, polyester elastomers, and nylon. Other suitable materials for inner portion 32 and outer portion 34 will become readily apparent to those skilled in the art, given the benefit of this disclosure.

In certain preferred embodiments, one or more ribs 62 may be provided on the exterior surface of outer portion 34. Ribs 62 serve to provide additional strength and rigidity for support assembly 30.

It is to be appreciated that inner portion 32 and outer portion 34 need not be the same size and shape as one another as seen in FIGS. 2-3. They may have different thicknesses, shapes and/or properties. Thus, outer portion 34 could be thicker or formed of a more dense material to provide additional support such as that found in a traditional heel counter. Similarly, inner portion 32 could be formed of a softer material to provide additional comfort for the user. Additionally, the thickness and/or other physical properties could vary within each of the inner portion 32 and outer portion 34.

Figure 4:
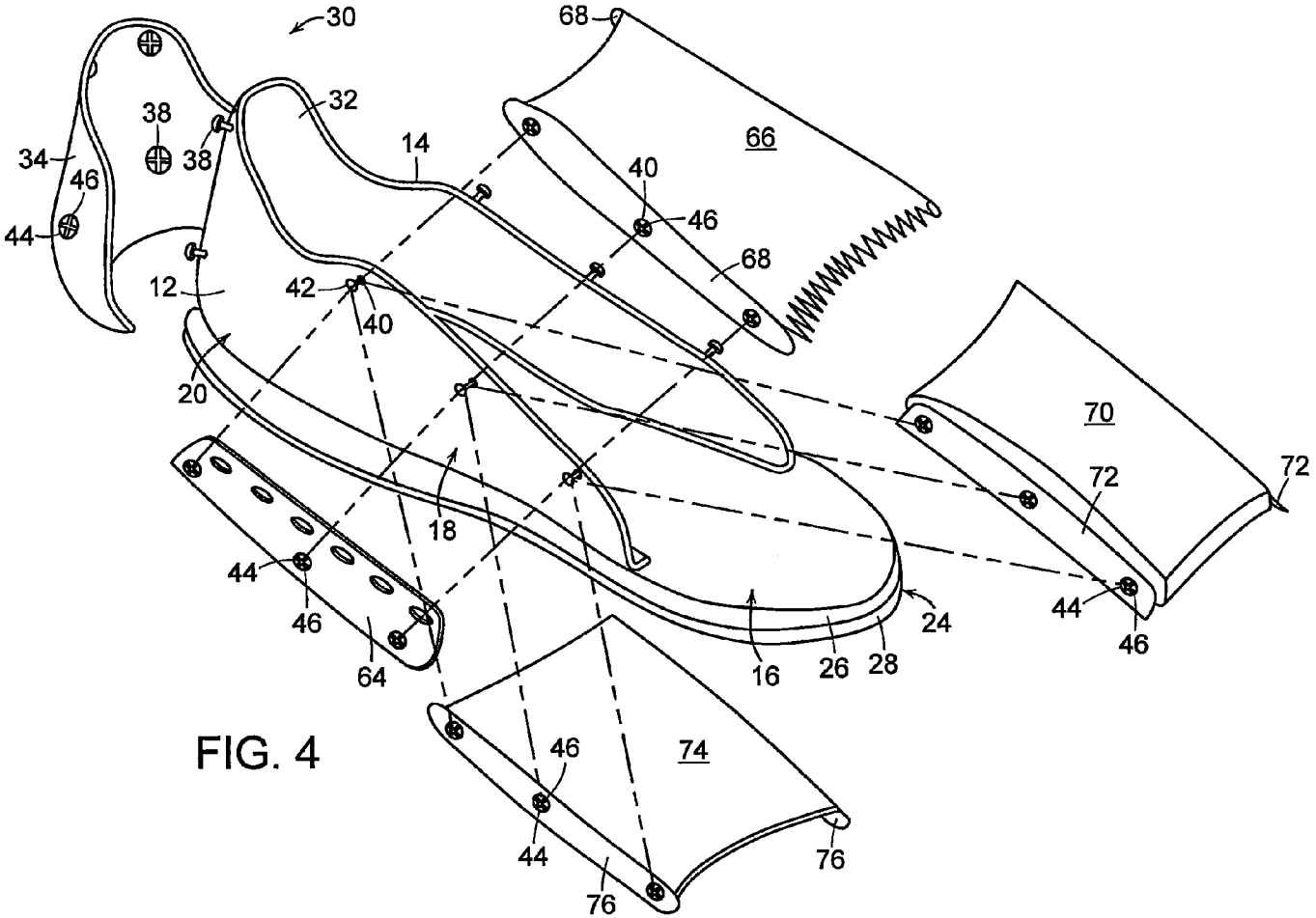
FIG. 4 is an exploded view of an alternative embodiment of a support assembly in accordance with the present invention, shown with a plurality of footwear accessories and secured to a sole assembly.

As illustrated in FIG. 4, inner portion 32 may extend from heel portion 20, through midfoot portion 18 and into forefoot portion 16, while outer portion 34 is similar to that shown in FIGS. 1–3 and extends only about heel portion 20. Inner portion 32 may be co-molded with sole assembly 24. For example, inner portion 32 could be co-molded with midsole 26.

In certain preferred embodiments, support assembly 30 may provide a supporting structure for footwear accessories secured to footwear 10. For example, as illustrated in FIG. 4, an eyestay 64 may be secured to support assembly 30. As illustrated here, eyestay 64 is secured to inner portion 32. It is to be appreciated that eyestay 64 may, in other preferred embodiments, be secured to outer portion 34. As illustrated here, eyestay 64 includes a flange 66 having second portions 44 and recesses 46, which receive projections 42 of inner portion 32. Thus, support assembly 30 provides a convenient way to secure an accessory such as eyestay 64 to footwear 10. Although only the medial eyestay 64 is illustrated here for clarity purposes, it is to be appreciated that a lateral eyestay 64 would likely be provided as well.

Another accessory illustrated in FIG. 4 is a rain shield 66, which includes a plurality of second portions 44 and recesses 46, which receive projections 42 on medial side 12 and lateral side 14 of inner portion 32. As illustrated here, second portions 44 and recesses 46 are formed in flanges 68 extending along medial and lateral sides of rain shield 66. Rain shield 66 serves to protect the laces and tongue (not shown here) of footwear 10 from rain and other moisture.

In other preferred embodiments, a pad 70 may be secured to footwear 10. Pad 70 may be used, for example, with footwear used in martial arts, and serves to protect the instep of the user's foot. As seen here, second portions 44 and corresponding apertures 46 are formed in flanges 72 secured to the medial and lateral sides of pad 70.

In another preferred embodiment, a ball control member 74 may be secured to footwear 10. Ball control member 74 may be used, for example, on a soccer cleat, and serves to improve the user's ability to control a soccer ball. Ball control member 74 may have a textured surface or be formed of a particular material suitable for increasing grip on a ball. As seen here, second portions 44 and corresponding apertures 46 are formed in flanges 76 secured to the medial and lateral sides of ball control member 74. It is to be appreciated that one or more footwear accessories may be secured to footwear 10 by way of being secured to support assembly 30. Although the footwear accessories illustrated here are functional in nature, it is to be appreciated that the footwear accessories secured to support assembly 30 may be purely aesthetic in nature, or may be partly functional and partly aesthetic.

Thus it can be appreciated that support assembly 30 provides a structure upon which footwear 10 can be customized by incorporating different components. As discussed above, different accessories or components can be secured to footwear 10 to adapt to different conditions or requirements of the user. By providing footwear 10 with a structure that is easily assembled, a customized article of footwear can easily and quickly be assembled to meet the specific requirements of a user in terms of size, fit, performance and functionality.

Figure 5:
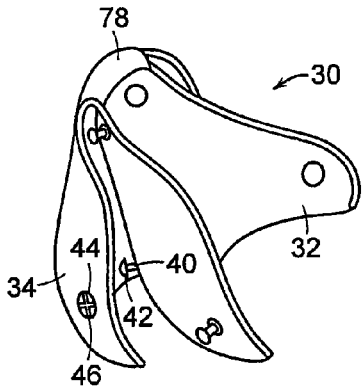
FIG. 5 is a perspective view of an alternative embodiment of the support assembly of FIG. 1.

Another embodiment of support assembly 30 is illustrated in FIG. 5, in which outer portion 34 and inner portion 32 are connected to one another by a hinge member 78. Hinge member 78 is preferably an elastic member, allowing inner portion 32 and outer portion 34 to easily be closed together over upper 22, facilitating assembly and also providing protection for the upper edge of upper 22, preventing moisture from entering footwear 10 at this point. Hinge member 78 may be formed of, for example, thermoplastic urethane (TPU), or a high flex modulus polyether block amide, such as PEBAX, which is manufactured by the Atofina Company, and, more particularly 40 Shore PEBAX.

Figure 6:
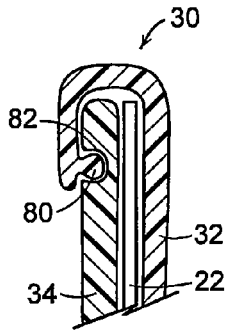
FIG. 6 is a section view of another alternative embodiment of the support assembly of FIG. 1.

Another embodiment of support assembly 30 is seen in FIG. 6, in which the upper portion of inner portion 32 extends over upper 22 and is bent over the upper edge of outer portion 34. One or more projections 80 on inner portion 32 are received in corresponding apertures 82 formed in an outer surface of outer portion 34, thereby securing inner portion 32 to outer portion 34. In a preferred embodiment, apertures 82 are slightly smaller than projections 80 such that projections 80 are received in apertures 82 in snap-fit fashion. Such a construction provides protection for the exposed upper edge of upper 22.

Figure 7:
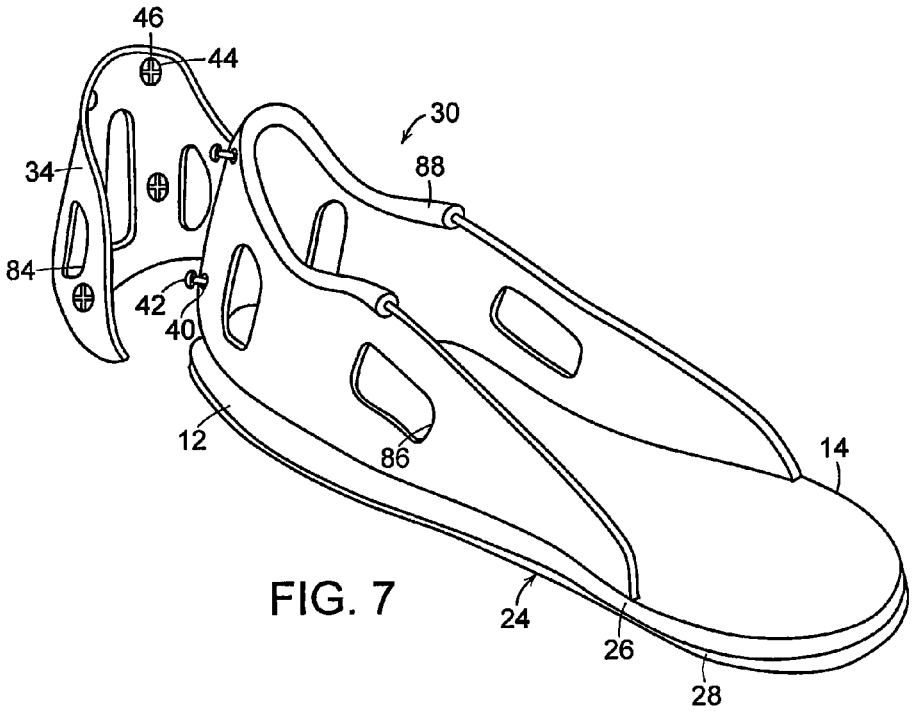
FIG. 7 is a perspective view of another alternative embodiment of a support assembly in accordance with the present invention, shown partially assembled and secured to a sole assembly.

Another preferred embodiment of support assembly 30 is shown in FIG. 7, in which a plurality of cutouts 84 are formed in outer portion 34 and a plurality of cutouts 86 are formed in inner portion 32. Cutouts 84 and 86 serve to reduce the weight of support assembly 30 and may provide aesthetic appeal for outer portion 34. In certain preferred embodiments, a collar 88 may be provided on support assembly 30 to provide support and comfort for the user's ankle. As illustrated here, collar 88 is positioned on inner portion 32. However, it is to be appreciated that collar 88 may, in certain preferred embodiments, be provided on outer portion 34. Collar 88 is preferably formed of a soft material such as foam, cloth, or an elastomer.

Figure 8:
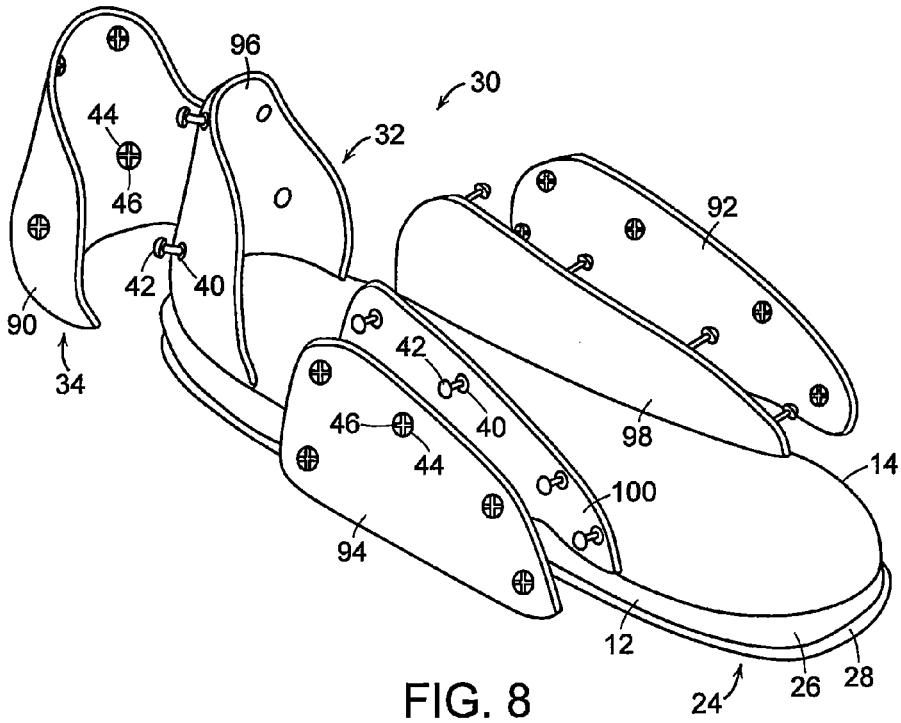
FIG. 8 is a perspective view of yet another alternative embodiment of a support assembly in accordance with the present invention, shown partially assembled and secured to a sole assembly.

Another preferred embodiment is shown in FIG. 8, in which the inner and outer portions of support assembly 30 are formed of multiple parts. As seen in the illustrated embodiment, outer portion 34 is formed of a heel portion 90, a lateral forefoot portion 92 and a medial forefoot portion 94. Inner portion 32 is formed of a heel portion 96, a lateral forefoot portion 98, and a medial forefoot portion 100. The lateral and medial portions may be formed of different materials, providing different levels of support and flexibility for medial side 12 and lateral side 14 of support assembly 30.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

a sole assembly;

a support assembly secured to the sole assembly and comprising an inner portion and an outer portion secured to the inner portion in a fixed non-rotational orientation with a fastener; and an upper, a portion of the upper being captured between the inner and outer portions of the support assembly, wherein the upper has a substantially flat U-shaped configuration when the footwear is in an unassembled condition, ends of arms of the U-shaped upper being captured between the inner and outer portions when the footwear is in an assembled condition.

2. The article of footwear of claim 1, wherein the upper is substantially flat prior to being captured between the inner and outer portions.

3. The article of footwear of claim 1, wherein the fastener comprises a plurality of projections on one of the inner and outer portions and a plurality of apertures on the other of the inner and outer portions, each aperture configured to receive a corresponding projection.

4. The article of footwear of claim 1, wherein the fastener comprises a plurality of projections on an outer surface of the inner portion and a plurality of apertures on an inner surface of the outer portion, each aperture configured to receive a corresponding projection.

5. The article of footwear of claim 1, wherein the fastener comprises a plurality of rivets.

6. The article of footwear of claim 1, wherein the fastener comprises a plurality of plastic rivets.

7. The article of footwear of claim 1, further comprising a footwear accessory secured to the article of footwear by the fastener.

8. The article of footwear of claim 7, wherein the accessory comprises a rain shield.

9. The article of footwear of claim 7, wherein the accessory comprises a pad.

10. The article of footwear of claim 7, wherein the accessory comprises a ball control member.

11. The article of footwear of claim 7, wherein the accessory comprises an eyestay.

12. The article of footwear of claim 1, wherein the sole assembly comprises a midsole and an outsole, the outer portion being secured to the midsole.

13. The article of footwear of claim 1, further comprising a plurality of ribs on an exterior surface of the outer portion.

14. The article of footwear of claim 1, wherein the inner portion comprises a plurality of pieces.

15. The article of footwear of claim 14, wherein the inner portion comprises a heel portion, a lateral forefoot portion and a medial forefoot portion.

16. The article of footwear of claim 1, wherein the outer portion comprises a plurality of pieces.

17. The article of footwear of claim 16, wherein the outer portion comprises a heel portion, a lateral forefoot portion and a medial forefoot portion.

18. The article of footwear of claim 1, wherein the support assembly forms a heel counter.

19. The article of footwear of claim 1, wherein the outer portion is secured to the sole assembly.

20. The article of footwear of claim 1, wherein the sole assembly includes a midsole and an outsole, the outer portion and the midsole being co-molded.

21. The article of footwear of claim 1, further comprising a hinge member connecting a portion of an upper edge of the outer portion to a portion of an upper edge of the inner portion.

22. The article of footwear of claim 21, wherein the hinge member is an elastic member.

23. The article of footwear of claim 1, further comprising a collar secured to one of the inner portion and the outer portion and configured to extend around an ankle of a user.

24. The article of footwear of claim 23, wherein the collar is formed of foam.

25. The article of footwear of claim 1, wherein the inner portion includes a plurality of cutouts.

26. The article of footwear of claim 1, wherein the outer portion includes a plurality of cutouts.

27. The article of footwear of claim 1, wherein an upper edge of a portion of the inner portion wraps over an upper edge of the outer portion and includes at least one projection, each projection received in a corresponding aperture formed in an outer surface of the outer portion.

28. An article of footwear comprising, in combination:

an upper assembly comprising:

a heel counter having an inner portion and an outer portion secured to the inner portion; and an upper having a flat substantially U-shaped configuration in an unassembled condition, ends of arms of the U-shaped upper being captured between the inner and outer heel counters in an assembled condition;

a midsole secured to the heel counter and upper of the upper assembly; and an outsole secured to the midsole.

29. The article of footwear of claim 28, wherein the outer portion is secured to the inner portion with a fastener.

30. The article of footwear of claim 29, wherein the fastener comprises a plurality of projections on one of the inner and outer portions and a plurality of apertures on the other of the inner and outer portions, each aperture configured to receive a corresponding projection.

31. The article of footwear of claim 29, wherein the fastener comprises a plurality of rivets.

* * * * *